United States Patent [19]

Miller

[11] Patent Number: 4,884,803

[45] Date of Patent: Dec. 5, 1989

[54] VARIABLE INCLINE EXERCISE APPARATUS

[76] Inventor: Jeffrey J. Miller, 2450 Westmont Way West, Seattle, Wash. 98199

[21] Appl. No.: 866,234

[22] Filed: May 22, 1986

[51] Int. Cl.[4] ..... A63B 23/02

[52] U.S. Cl. ..... 272/145

[58] Field of Search ..... 272/144, 145; 128/25 R, 128/33, 69, 75; 5/62, 509, 11

[56] References Cited

U.S. PATENT DOCUMENTS

| | | | |
|---|---|---|---|
| 1,328,802 | 1/1920 | Anderson | 5/62 |
| 1,542,766 | 6/1925 | Hall | 272/144 X |
| 2,817,522 | 12/1957 | Margultes | 272/145 |
| 4,194,499 | 3/1980 | Donnelly, Jr. | 5/62 |
| 4,194,500 | 3/1980 | Grimaldi | 272/144 X |
| 4,512,572 | 4/1985 | Hamm | 272/144 |
| 4,531,730 | 7/1985 | Chenera | 272/144 |
| 4,549,534 | 10/1985 | Zagorski et al. | 128/25 R |
| 4,672,697 | 6/1987 | Schurch | 5/62 |

*Primary Examiner*—Richard J. Apley
*Assistant Examiner*—J. Welsh
*Attorney, Agent, or Firm*—Jeffrey J. Miller

[57] ABSTRACT

An apparatus is disclosed which cyclically varies the angle of incline of an elongate member or board of the apparatus, thus allowing the user the benefits of a continually varying angle without interrupting the exercise regimen. The exercise apparatus of the present invention comprises an elongate member having first and second ends. Disposed at the first end of the elongate member are rollers. Additionally, a mechanism for reversibly inclining the second end of the elongate member to a predetermined height are also provided.

11 Claims, 1 Drawing Sheet

VARIABLE INCLINE EXERCISE APPARATUS

DESCRIPTION

1. Technical Field

This invention pertains to exercise equipment generally, and more particularly, to variable incline exercise apparatus to be utilized in conjunction with exercises such as sit-ups, leg lifts and push-ups.

2. Background Art

Sit-ups, leg lifts and push-ups are universally employed exercises utilized for conditioning and toning the abdominal, leg and torso muscle groups. Prior art apparatus utilized in performing these types of exercises include a board or plank providing a planar surface upon which the exercises can be performed. A strap or other means for restraining the feet or ankles is generally provided for sit-ups.

The typical apparatus also includes a vertical ladder positioned at one end of the board permitting the user to incrementally change the angle of the board by selective attachment of the end of the board to the rungs of the ladder. This arrangement requires that the user discontinue his exercise protocol each time the angle of incline of the apparatus is desired to be changed. The term "angle of incline," as used herein, shall mean the included angle defined by a substantially horizontal surface upon which the apparatus is positioned and the plane of the board or plank.

It has been found by athletes and others involved in exercise programs for muscle conditioning and toning that continually varying the resistance on a selected muscle group results in a more complete exercise regimen. In the case of sit-ups and leg lifts, it is desirable to continually vary the angle of the incline in order that all muscles in the abdominal muscle group are uniformly exercised.

DISCLOSURE OF THE INVENTION

It is one of the objects of this invention to provide apparatus for continually varying the angle of incline of an exercise board intended to be used while performing sit-ups and other exercises. An apparatus is disclosed which cyclically varies the angle of incline of an elongate member or board of the apparatus, thus allowing the user the benefits of a continually varying angle without interrupting the exercise regimen.

The exercise apparatus of the present invention comprises an elongate member having first and second ends. Disposed at the first end of the elongate member are roller means. Additionally, means for reversibly inclining the second end of the elongate member to a predetermined height are also provided. The roller means permit substantially horizontal displacement of the first end of the board as the second end is substantially vertically displaced.

In a preferred embodiment, the means for reversibly inclining the second end of the elongate member comprises a base having a substantially vertically disposed screw which has a first end rotatably coupled to the base. A reversible motor is provided which is mounted to the base and coupled to the second end of the screw for selectively rotating the screw about its longitudinal axis in a clockwise or counterclockwise direction of rotation. Follower means pivotally coupled to the second end of the elongate member are provided for engaging the screw.

BEST MODE FOR CARRYING OUT THE INVENTION

Figure 3:
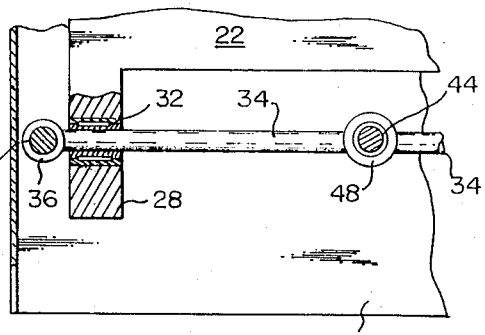
FIG. 3 is a partial cross-sectional view on line 3—3 of the apparatus of FIG. 2 constructed according to the principles of this invention.
Figure 2:
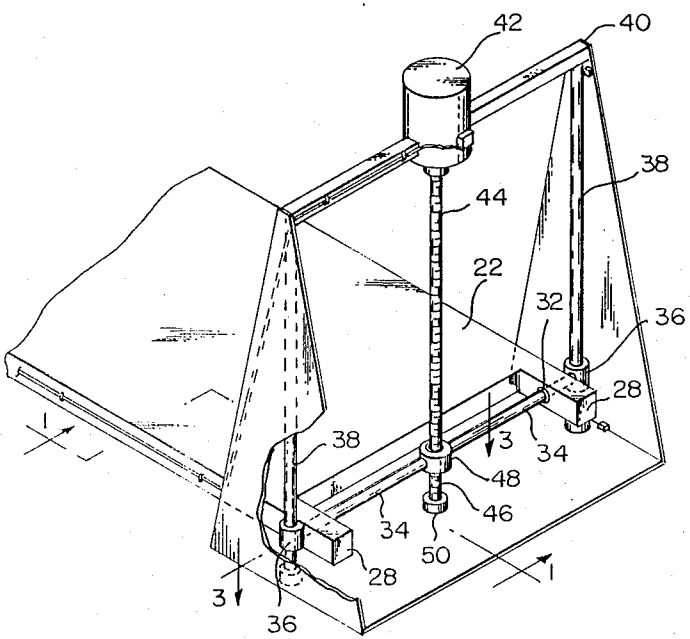
FIG. 2 is an isometric view depicting the details of a preferred embodiment of the means for reversibly inclining one end of the elongate member.
Figure 1:
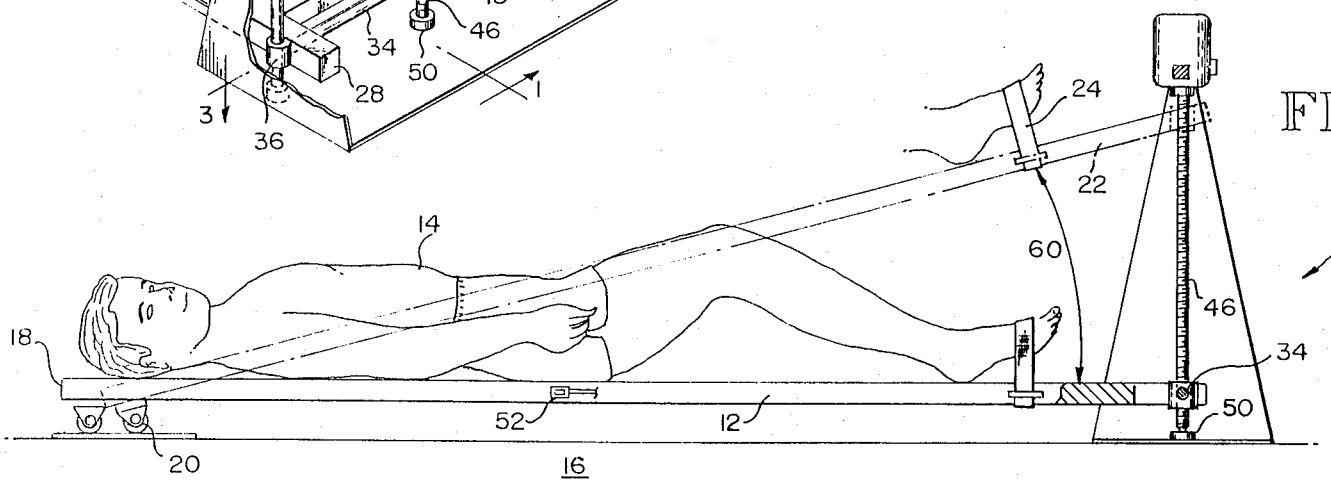
FIG. 1 is a side elevation depicting a partial cross-sectional view of line 1—1 of FIG. 2.

Referring to FIGS. 1, 2 and 3, a preferred embodiment of the variable incline exercise apparatus 10 of the present invention is shown. This apparatus comprises an elongate member or board 12 having sufficient length, width and thickness to accommodate the typical anticipated user 14. The board can be constructed from wood, metal, plastic or other material sufficiently rigid to accommodate the weight of the user. The board can be flat or have a "hump" on the top of the board, positioned to provide support under the knees of the user. The apparatus is typically positioned on a floor or other suitable flat, substantially horizontal surface 16.

Disposed at the first end 18 of the board 12 is one or more rollers 20. The rollers or casters are suitably attached to the end of the board to permit the first end to transverse a portion of the floor while the apparatus is being operated.

In the vicinity of the second end 22 of the board 12 is a strap 24 traversing the width of the board and attached at each of its ends to the sides of the board. This strap provides purchase for restraining the user's feet or ankles when doing sit-ups.

Also disposed at the second end 22 of the board 12 is a base 26 which is pivotally coupled to the end of the board. Preferably, the base comprises a stamped or cast metallic structure having sufficient structural strength to support the weight of the user and the apparatus. Optionally, the base can be removably attached to the floor by means of bolts or other fastening devices. Alternatively, the base can be attached to a wall or other fixed object. The geometry of the base is selected to accommodate the surface upon which it rests or to which it is attached.

Extending from the second end 22 of the board 12 are a pair of bosses 28, each defining a seat for an associated sleeve bearing 32. A two-piece transverse shaft 34 has one end of each piece rotatably journaled within the bearings and extends through the bosses. The ends of each piece of the transverse shaft which are not rotatably journaled with the bearings are fixedly attached to a follower 48.

Disposed at each journaled end of said transverse shaft 34 is a slide bearing 36. Each slide bearing slidably engages one member of a pair of parallel vertical guides 38. Preferably, each end of the vertical guides is fixedly attached to the base. The guides serve to reduce torsional rotation of the board 12 about its longitudinal axis.

A cross-member 40 is fixedly attached at each of its ends to the top of the base 26 and provides a mounting member for a reversible electric motor 42. A shaft 44 is coupled to the motor 42. The shaft has a continuous thread 46 along a portion of the length of the shaft. The thread of the shaft is cooperatively engaged with the follower 48. The end of the shaft which is not coupled to the motor is rotatably coupled to the base by journaling the same within a bearing 50.

An on/off/reverse switch 52 is provided and is conveniently attached to the board 12 within easy reach of the user 14. In the case of sit-ups, operation of the apparatus 10 of the present invention is accomplished by the user 14 positioning himself on the board 12 such that his feet or ankles are restrained by the strap 24. The user then activates the motor 42 by means of the switch 52. The motor rotates the threaded shaft 44 in the direction selected by the user. Thus, the board can be selectively raised or lowered, depending upon the direction of rotation of the motor and threaded shaft 44.

As the threaded shaft rotates, the follower 48 is caused to be raised or lowered vertically along the axis of the threaded shaft. This results in the second end 22 of the board 12 being selectively raised or lowered while the motor is activated. As the board is inclined or declined, the angle of incline 60 concomitantly changes. Because the length of the board 12 is fixed and because the second end 22 of the board is maintained in a vertical plane, changes in the angle of incline result in the first end 18 of the board traversing the surface 16 by means of the rollers or casters 20. Vertical displacement of the second end of the board is proportional to the sine of the angle of incline. Also, as the angle of incline varies, the rotatably journaled transverse shaft 34 rotates within its bearings 32 to permit smooth operation of the apparatus.

The pitch of the threads 46 on the shaft 44 and the rotational speed of the motor 42 are selected to provide the desired rate of incline or decline. Alternatively, an adjustable-speed motor can be provided to permit the user to vary the rate of incline or decline according to the desired exercise regimen.

As the second end 22 of the board 12 approaches the motor 42 during the incline phase, the user 14 reverses the direction of the motor to cause the board to decline. This can be accomplished, without the user having to interrupt his sit-up exercise, by activating the switch 52 to reverse the direction of the motor.

Alternative preferred embodiments provide that adjustable limit switches (not shown) be employed so the user can selectively adjust the lower and upper limit for the traverse of the second end of the board. These adjustable limit switches automatically reverse the direction of the motor so that the apparatus will cycle through alternating phases of inclination and declination without intervention of the user.

In still another alternative preferred embodiment, the thread defined by the shaft 44 can be of the type that reverses direction at each extreme. This arrangement would allow the apparatus to cyclically incline and decline without stopping and reversing the motor. Other preferred embodiments provide for additional circuitry to continually vary the speed of the inclination/declination and the length of the workout.

Still other alternative preferred embodiments provide for hydraulic means to be utilized in raising and lowering one end of the board. Hydraulic devices well known to those skilled in the art can be employed for this purpose so long as the angle of incline of the apparatus can be continuously, cyclically varied.

While the details of this apparatus have been described, it should be understood that variations would be apparent to one skilled in the art without departing from the principles herein. Accordingly, the invention is not to be limited to the specific embodiments illustrated herein, but only by the claims and their equivalents appended hereto.

I claim:

1. An automatic, variably inclinable exercise apparatus, comprising;

a support surface for a user;

means for pivoting the support surface relative to a horizontal reference;

means, on the support surface, for releasably restraining the feet of a user during an abdominal muscle toning exercise; and means for automatically controlling the pivoting means so that the angle defined by the support surface and the horizontal reference is automatically and cyclically varied to cyclically inclinate and declinate the support surface during an abdominal muscle toning exercise, so that a continuously varying load is felt by a user during a single repetition of the abdominal muscle toning exercise.

2. The apparatus of claim 1 wherein the support surface is a board or plank adapted for sit-up, leg-lift and push-up exercises.

3. The apparatus of claim 1, additionally comprising horizontal displacement means disposed at one end of the support surface for permitting substantial horizontal displacement of said end.

4. The apparatus of claim 3 wherein the horizontal displacement means comprises at least one cylindrical roller axially mounted to one end of the support surface to permit the substantially horizontal displacement of the support surface as the opposite end of the surface is substantially vertically displaced.

5. The apparatus of claim 1, additionally comprising guide means for guiding one end of the support surface substantially vertically while limiting the rotation of the surface along its longitudinal axis.

6. The apparatus of claim 1 wherein the means for automatically controlling the pivoting means comprises:

a base;

a vertically disposed screw having a first end rotatably coupled to said base;

a reversible motor mounted to said base, coupled to a second end of said screw for selectively rotating said screw about its longitudinal axis in a clockwise or counterclockwise direction of rotation; and follower means engaging said screw, said follower pivotally coupled to one end of the support surface.

7. An exercise apparatus comprising:

an elongate member having first and second ends;

horizontal displacement means disposed at the first end of said elongate member for permitting substantial horizontal displacement of the first end;

restraint means, adjacent to the second end of the elongate member, for releasably restraining the feet of a user during an abdominal muscle toning exercise; and automatic means for reversibly and cyclically displacing the second end of said elongate member in a substantially vertical plane to cyclically inclinate and declinate the elongate member during an abdominal muscle toning exercise, so that a continuously varying load is felt by a user during a single repetition of the abdominal muscle toning exercise.

8. The apparatus of claim 1 wherein the elongate member is a board or plank adapted for sit-up, leg-lift and push-up exercises.

9. The apparatus of claim 1 wherein the horizontal displacement means comprises at least one cylindrical roller axially mounted to the first end of the elongate member to permit the substantially horizontal displacement of said member as the second end of the member is substantially vertically displaced.

10. The apparatus of claim 1, additionally comprising guide means for guiding the second end of the elongate member substantially vertically while limiting the rotation of the elongate member along its longitudinal axis.

11. The apparatus of claim 1 wherein the automatic means for reversibly displacing the second end of the elongate member comprises:

a base;

a vertically disposed screw having a first end rotatably coupled to said base;

a reversible motor mounted to said base coupled to a second end of said screw for selectively rotating said screw about its longitudinal axis in a clockwise or counterclockwise direction of rotation; and follower means engaging said screw, said follower pivotally coupled to the second end of said elongate member.

* * * * *